US006968818B2

(12) United States Patent
Plank et al.

(10) Patent No.: US 6,968,818 B2
(45) Date of Patent: Nov. 29, 2005

(54) CAMSHAFT ADJUSTER

(75) Inventors: Jens-Uwe Plank, Berlin (DE); Jörg Rösener, Berlin (DE); Holger Rudzinski, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/996,815

(22) Filed: Nov. 24, 2004

(65) Prior Publication Data

US 2005/0092275 A1 May 5, 2005

Related U.S. Application Data

(63) Continuation-in-part of application No. PCT/EP03/03002, filed on Mar. 22, 2003.

(30) Foreign Application Priority Data

May 25, 2002 (DE) ..... 102 23 409

(51) Int. Cl.[7] ..... F01L 1/34
(52) U.S. Cl. ..... 123/90.17; 123/90.15; 123/90.31
(58) Field of Search ..... 123/90.17, 90.15, 123/90.31

(56) References Cited

U.S. PATENT DOCUMENTS 5,823,152 A * 10/1998 Ushida ..... 123/90.17
6,491,009 B1 12/2002 Schmaler et al.
6,505,586 B1 1/2003 Sato et al.

FOREIGN PATENT DOCUMENTS

| | | |
|---|---|---|
| DE | 196 23 818 | 12/1996 |
| EP | 0 818 610 | 1/1998 |
| JP | 11 241608 | 9/1999 |

* cited by examiner

*Primary Examiner*—Thomas Denion
*Assistant Examiner*—Zelalem Eshete
(74) *Attorney, Agent, or Firm*—Klaus J. Bach

(57) ABSTRACT

In a camshaft adjuster for an internal combustion engine comprising a blade wheel, which is rotationally connected to a camshaft and which is mounted in a driving part so as to be able to rotate in a limited manner, starting from an inner base circle and extending to an outer peripheral circle, the blade wheel, with its blades, engages inside intermediate spaces formed by radial projections of the driving part. A pressure chamber is formed in the peripheral direction on both sides of a blade and can be supplied with pressure oil via a control valve so that the blade wheel is displaced relative to the driving part about an angle according to the pressure ratios existing inside the pressure chambers. In addition, a locking bolt, which can be hydraulically unlocked and which is subjected to the action of a pressure spring in a locking direction, may lock the blade wheel to the driving part. The locked position is situated between two end positions of the blade wheel. After a startup phase, the bolt is firmly held disengaged by a pressurized system fluid to safely prevent locking of the bolt.

3 Claims, 2 Drawing Sheets

CAMSHAFT ADJUSTER

This is a Continuation-In-Part Application of international application PCT/EP03/03002 filed Mar. 22, 2003 and claiming the priority of German application 102 23 409.4 filed May 25, 2002.

BACKGROUND OF THE INVENTION

The invention relates to a camshaft adjuster for an internal combustion engine comprising a vane wheel which is firmly mounted on a camshaft for rotation therewith and rotatably supported in a drive component in which the vanes extending from a base cylinder into partial annular chambers formed by radially inwardly extending wall members of the drive component so that, in circumferential direction at opposite sides of each vane, a pressure chamber is formed to which pressurized oil can be admitted for adjusting the angular position of the vane wheel relative to the drive component.

Camshaft adjusters are used in connection with valve controlled internal combustion engines in order to change the angular position of the camshaft relative to the crankshaft of the engine. In this way, the opening and closing times of the gas exchange valves relative to the top dead center position of a piston can be advanced or retarded so as to optimize the charge change of the combustion chamber or, respectively, the cylinders depending on the respective operating point of the internal combustion engine.

DE 196 23 818 A1 discloses a camshaft adjuster which includes a vane wheel. The vane wheel is mounted on the camshaft for rotation therewith and supported in a drive component so as to be rotatable relative thereto over a limited range. The drive component is driven by the crankshaft of the internal combustion engine generally by means of a toothed belt. The vanes of the vane wheel extend into spaces in the drive component which are formed between radially inwardly extending projections of the drive component. The projections delimit a maximum angular range within which the vane wheel is rotatable relative to the drive component. Between the vanes and the projections hydraulic pressure chambers are formed which are controlled by a control valve, by which pressurized oil is supplied to, or released from, the hydraulic pressure chambers so that the position of the vane wheel relative to the drive component is obtained by the pressure conditions in the pressure chambers disposed at circumferentially opposite sides of the vanes. When the engine is not operating the vane wheel is moved by springs to one of its end positions in the drive component and locked therein by a locking bolt which is axially slidably supported either in the vane wheel or in the drive component and extends into a locking bore in the drive component or, respectively, the vane wheel. In the locked end position of the vane wheel the camshaft must be in an angular position relative to the crankshaft in which the internal combustion engine can be easily started. After engine startup, the angular position of the vane wheel relative to the crankshaft is controlled in accordance with a performance graph of the internal combustion engine. Since the locked end position of the vane wheel limits the advancing or retarding adjustment of the camshaft, the timing of the gas exchange valves cannot be advanced or retarded beyond this end position during operation of the engine.

The vane wheel must be locked during the startup phase in order to prevent undesired movements of the vane wheel and the camshaft, by oscillations for example, during the startup phase in which the vane wheel cannot yet be stabilized by an adequate operating pressure. As soon as a sufficient operating pressure has developed in one of the chambers so that the position of the vane wheel in the drive component can be stabilized, the locking bolt is moved by the operating pressure out of the locking bore and remains in such a release position as long as a sufficient operating pressure is present in the chamber.

Camshaft adjusters are also suitable for changing the relative angular positions of two camshafts of which one actuates the inlet valves and the other actuates the outlet valves.

It is the object of the present invention to optimize the operation of an internal combustion engine by optimizing the adjustment range for the relative angular positions of the vane wheel, that is, the camshaft and the drive component.

SUMMARY OF THE INVENTION

In a camshaft adjuster for an internal combustion engine comprising a blade wheel, which is rotationally connected to a camshaft and which is mounted in a driving part so as to be able to rotate in a limited manner, starting from an inner base circle and extending to an outer peripheral circle, the blade wheel, with its blades, engages inside intermediate spaces formed by radial projections of the driving part. A pressure chamber is formed in the peripheral direction on both sides of a blade and can be supplied with pressure oil via a control valve so that the blade wheel is displaced relative to the driving part about an angle according to the pressure ratios existing inside the pressure chambers. In addition, a locking bolt, which can be hydraulically unlocked and which is subjected to the action of a pressure spring in a locking direction, may lock the blade wheel to the driving part. The locked position is situated between two end positions of the blade wheel. After a startup phase, the bolt is firmly held disengaged by a pressurized system fluid to safely prevent locking of the bolt.

The intermediate position of the vane wheel in the drive component must be safely reached and locked when the engine is shut down, but it must also be ensured that, during engine operation, the locking position can be passed without the locking bolt entering the locking bore. This is achieved by the arrangement according to the invention wherein, during the startup phase of the engine, the locking bolt is operated against the force of the compression spring only by a control pressure provided by a control valve until the bolt is fully disengaged whereas during normal engine operation, the bolt is held in the release position by a system pressure. In this way, it is ensured that the locking bolt is not disengaged before the vane wheel can be stabilized in its position by the operating pressure and the bolt cannot enter the locking bore during normal engine operation as it is firmly held in its release position by the system pressure until the engine is shut down and the system pressure collapses.

In a particular embodiment of the invention the locking bolt includes a central bore which is in communication with an annular groove by way of a radial bore and extends to the front face of the locking bolt which effectively forms a piston face area adjacent a locking bore.

The pressure space formed between the front face of the locking bolt and the locking bore which is in the form of a pocket bore is, in the locking position of the locking bolt, in communication with an operating pressure fluid supply line and, in the release position of the locking bolt, with a system pressure fluid supply line, while the respective other fluid supply line is blocked. Consequently, the locking bolt is first subjected to, and actuated by, the operating fluid. With increasing pressure of the operating pressure fluid the operating pressure fluid supply line is blocked and the system pressure fluid supply line is placed in communication with the pressure space at the front face of the locking bolt. In the release position of the locking bolt, the locking bolt front face is subjected to the system pressure fluid and is firmly held in the release position as long as the engine is in operation.

In order to prevent a hydraulic pressure-build up in the spring chamber of the end of the bolt opposite the front face thereof, it is expedient if the spring chamber is in communication with a pressure-free area by a relief passage.

The invention will become more readily apparent from the following description of a particular embodiment thereof described with reference to the accompanying drawings.

DESCRIPTION OF A PREFERRED EMBODIMENT

Figure 1:
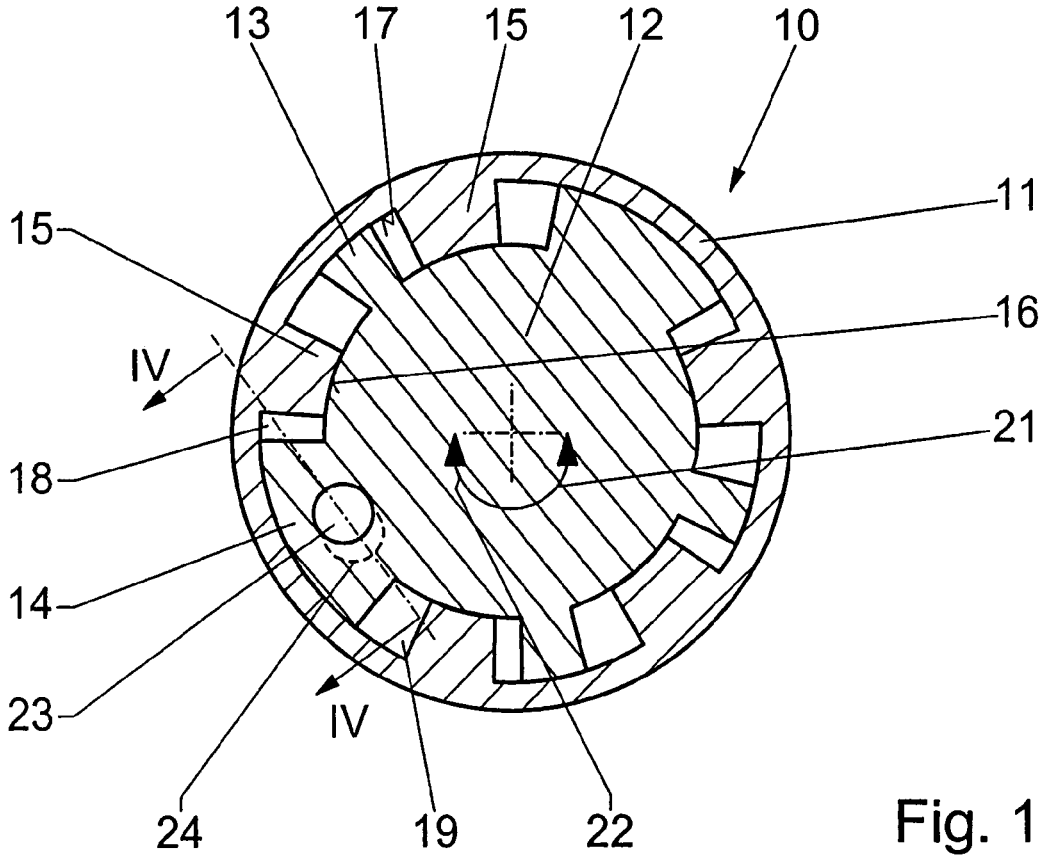
FIG. 1 shows, in cross-section, a camshaft adjuster in an unlocked position.

A camshaft adjuster 10 includes a drive component 11, which is operatively connected to a crankshaft or a second camshaft, which however are not shown. The drive component 11 is in the form of a drum in which a vane wheel 12 is supported so as to be rotatable therein over a limited angular range. As indicated by the arrow 21, the vane wheel 12 can adjust the angular position of the camshaft connected thereto for rotation therewith such that the timing of the gas exchange valves is retarded or advanced depending on the direction of rotation of the vane wheel 12 in the drive component 11. The cam adjuster may also be used for adjusting the timing of the inlet valves relative to the timing of the exhaust valves if the inlet and the outlet valves are operated by different camshafts.

The angular position adjustment of the vane wheel 12 relative to the drive component 11 is achieved hydraulically by pressurizing or depressurizing chambers 18, 19 formed at opposite sides of the vanes 13, 14 extending into recesses formed between projections 15 projecting radially into the cut-outs between adjacent vanes 13, 14 of the vane wheel 12. Pressurized fluid is admitted or released from the chambers 18, 19 by a control valve which is not shown herein. Depending on the pressure conditions in the chambers 18, 19, which extend radially between an inner base circle 16 and an outer circle 17, the vane wheel 12 is rotated relative to the drive component 11 in the adjustment direction 21 or 22, respectively.

The camshaft adjuster 10 includes a locking mechanism comprising a locking bore 24 in the form of a pocket bore extending into a cover 20 of the drive component 11 and a locking bolt 23 which is axially movably supported in a bore in the vane wheel 12 and which is biased by a compression spring 30 into a locking position in which its front end is received in the locking bore 24.

Figure 2:
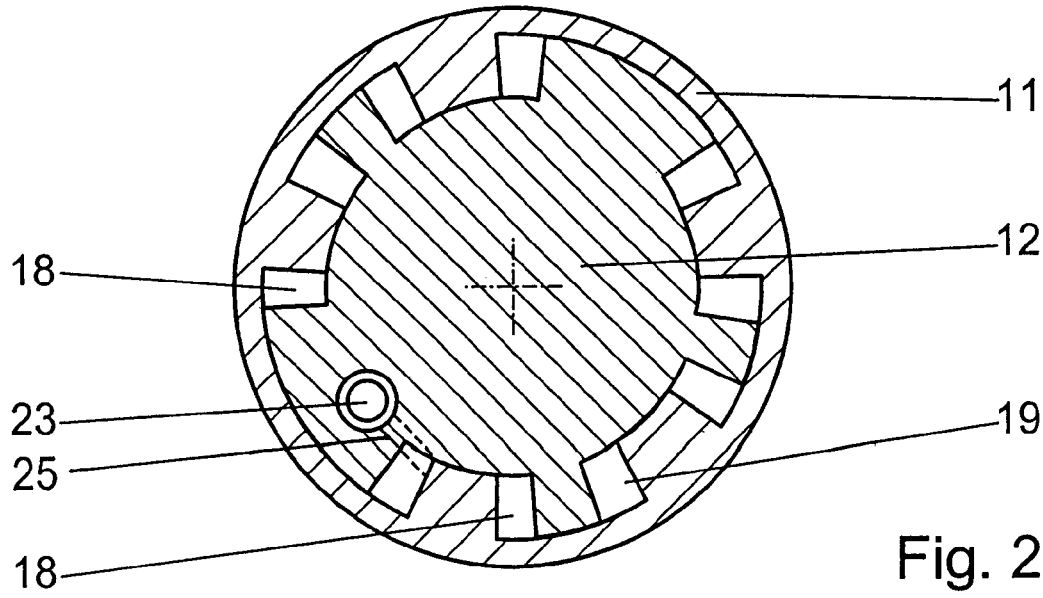
FIG. 2 shows, in cross-section, a camshaft adjuster in a locked position.
Figure 3:
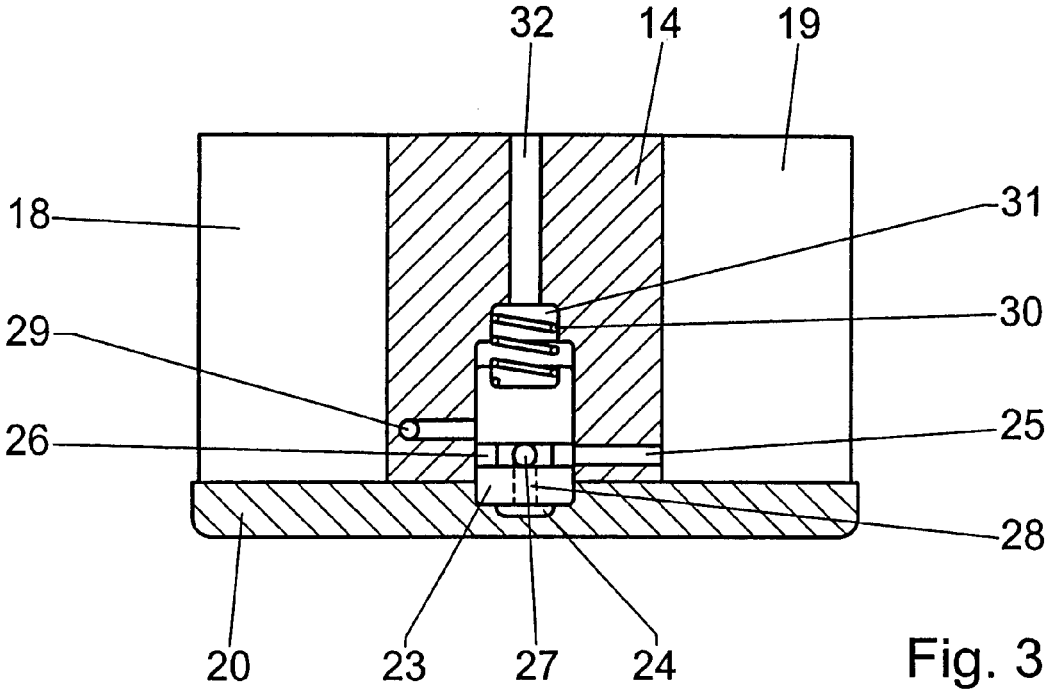
FIG. 3 shows schematically, in a cross-sectional view, a locking mechanism in the locked position.

The locking position as shown in FIGS. 2 and 3 is assumed by the vane wheel 12 when the internal combustion engine is shut down. In this position, the valve timing is such that starting of the engine is facilitated.

Figure 4:
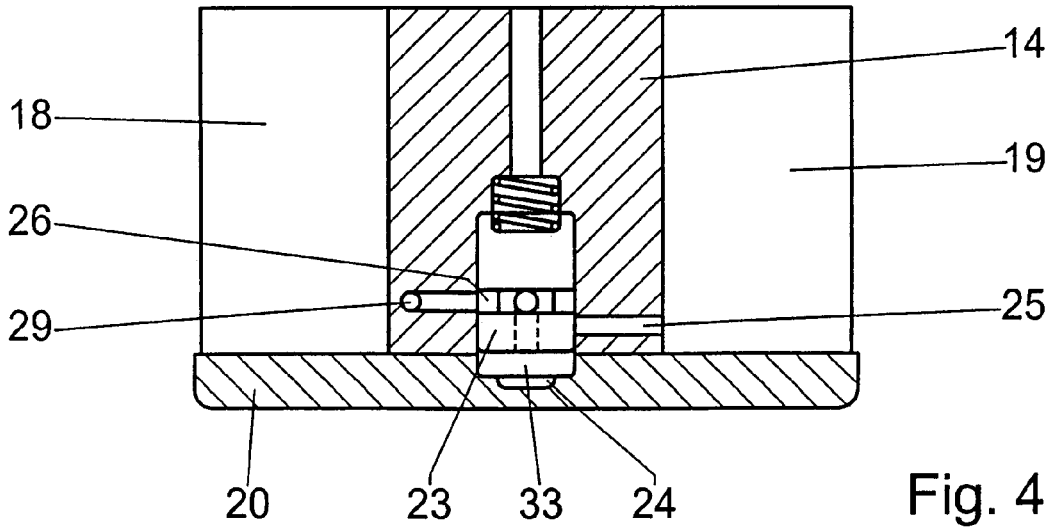
FIG. 4 shows schematically, in a cross-sectional view taken along line IV—IV of FIG. 1, the locking mechanism in a locking position.

To disengage the locking bolt 23 from the locking bore 24 pressurized fluid is supplied to a pressure chamber 33 which is formed between the front face of the locking bolt 23 and the wall of the locking bore 24, by way of a pressurized operating fluid line 25, a circumferential groove 26 in the locking bolt 23, a radial bore 27 and a central bore 28. The pressurized fluid line 25 extends for example to the pressure chamber 19 to which engine oil is supplied. When, in the start-up phase of the internal combustion engine, the operating pressure of the engine oil increases in excess of a certain value so that a force is applied to the locking bolt 23 which is determined by the front face area of the locking bolt 23 and the spring force of the compression spring 30, the locking bolt 23 is moved out of its locking position and to its release position as shown in FIG. 4. In this position, the pressurized fluid supply line 25 is blocked by the locking bolt and the annular groove 26 is placed into communication with a system pressure supply line 29 providing a pressure which holds the locking bolt 23 in the release position as long as the system pressure is provided by the internal combustion engine. It is ensured in this way that the locking bolt 23 will not enter the locking bore 24 when passing the locking bore 24 during normal engine operation.

It is of course possible that leakage oil leaking past the locking bolt 23 into a spring chamber 31 at the end of the locking bolt 23 opposite the pressure chamber 33. In order to prevent a hydraulic pressure buildup in the spring chamber 31, the spring chamber is in communication with a pressure-free area by a relief bore 32 extending through the vane 14.

In the embodiment shown herein, the locking bolt 23 is arranged in the vane wheel 12 and the locking bore 24 is arranged in the drive component 11. However, this arrangement may be reversed. Furthermore, it is apparent from FIGS. 1 and 2, that the vanes 13 are shorter in the circumferential direction than the vanes 14, which are include the locking bolt 23, the locking bolt being shown only in one of the wider vanes 14.

What is claimed is:

1. A camshaft adjuster for an internal combustion engine, comprising: a drive wheel (11) including a housing drum with walls (15) extending radially inwardly from the housing drum (11) in circumferentially spaced relationship, so as to form annular spaces (18, 19) therebetween, a vane wheel (12) rotatably supported in said housing drum (11) and having a cylindrical base body in sealing contact with the radially inwardly extending housing drum walls (15) and vanes (13, 14) extending radially outwardly from the base body of said vane wheel (12) into said annular spaces (18, 19) and having radially outer end faces in sealing contact with the inner circumferential wall (17) of said housing drum (11) and being of smaller circumferential width than the annular spaces so as to form at opposite sides of each vane (13, 14) pressure chambers (18, 19) to which pressurized fluid can be admitted in a controlled manner for adjusting the angular position of the vane wheel (12) relative to the drive wheel, a locking device consisting of a spring-loaded locking bolt (23) arranged in one of the housing drum (11) and the vane wheel (12) and a locking bore formed in the other of the housing drum (11) and the vane wheel (12) for receiving the locking bolt (23) and rotationally interlocking the housing drum (11) and the vane wheel (12), said locking bolt (23) being subjected during an engine startup phase to a hydraulic fluid pressure provided for controlling the vane wheel position until the locking bolt (23) is fully disengaged and means for transferring the pressure control for actuating the locking bolt (23) to a system pressure supply line (29) during operation of the engine after the startup phase thereof so that the locking bolt (23) remains safely disengaged during engine operation, said locking bolt (23) including hydraulic fluid pressure control passages for effecting the transfer of the pressure control for actuating the locking bolt (23) to said pressure supply line.

2. A camshaft adjuster according to claim 1, wherein the locking bolt (23) includes adjacent the locking bore (24) a front end with a central bore (28) extending into said locking bolt 23 from the front end thereof, an annular groove (26), and a radial bore (27) extending between the annular groove (26) and the central bore (28), said annular groove (26) being disposed in the locking position of the locking bolt (23), in which its front end is received in the locking bore (24), in a position in which the groove (26) is in communication with a pressurized operating fluid supply line (25) and, in a release position of the locking bolt (23), in communication with the system pressure fluid line (29) wherein the respective other supply line (25, 29) is blocked.

3. A camshaft adjuster according to claim 1, wherein said locking bolt (23) is spring loaded by a compression spring (30) which is arranged in a spring chamber (31) and the spring chamber (31) is in communication with a low pressure area by a relief passage (32) extending from the spring chamber (31).

* * * * *